US008673090B2

(12) United States Patent
Yoon et al.

(10) Patent No.: US 8,673,090 B2
(45) Date of Patent: Mar. 18, 2014

(54) DISHWASHER

(75) Inventors: Sang Heon Yoon, Seoul (KR); Jae Won Chang, Seoul (KR); Young Hwan Park, Seoul (KR); Gap Su Shin, Seoul (KR); Joon Ho Pyo, Seoul (KR)

(73) Assignee: LG Electronics Inc., Seoul (KR)

( * ) Notice: Subject to any disclaimer, the term of this patent is extended or adjusted under 35 U.S.C. 154(b) by 1009 days.

(21) Appl. No.: 12/540,977

(22) Filed: Aug. 13, 2009

(65) Prior Publication Data

US 2010/0043847 A1 Feb. 25, 2010

(30) Foreign Application Priority Data

Aug. 21, 2008 (KR) ..... 10-2008-0081801

(51) Int. Cl.
*A47L 15/42* (2006.01)

(52) U.S. Cl.
USPC ..... 134/115 G; 134/56 D; 134/57 D; 134/58 D; 134/110

(58) Field of Classification Search
USPC ..... 134/56 D, 57 D, 58 D, 115 G, 198, 110
See application file for complete search history.

(56) References Cited

U.S. PATENT DOCUMENTS

| | | | | |
|---|---|---|---|---|
| 2006/0054199 | A1 * | 3/2006 | Yoon et al. | 134/56 D |
| 2006/0060222 | A1 * | 3/2006 | Park et al. | 134/56 D |
| 2006/0060224 | A1 * | 3/2006 | Yoon et al. | 134/56 D |
| 2008/0163901 | A1 * | 7/2008 | Woo | 134/105 |

FOREIGN PATENT DOCUMENTS

| | | |
|---|---|---|
| CN | 2803522 | 8/2006 |
| CN | 1883367 | 12/2006 |
| CN | 1899199 | 1/2007 |
| WO | WO 2006001609 A1 * | 1/2006 |

OTHER PUBLICATIONS

Chinese Office Action dated Dec. 21, 2010 for related Chinese Application No. 200910167345.5.

* cited by examiner

*Primary Examiner* — Michael Barr
*Assistant Examiner* — Benjamin L Osterhout
(74) *Attorney, Agent, or Firm* — KED & Associates LLP

(57) ABSTRACT

A water flow control device for an appliance includes a sump to collect water from a washtub, a supply passage to supply water from the sump to the washtub, a drain passage, coupled to the sump to discharge water; and a disposer to dispose contaminates in water from the sump. The disposer is in fluid communication with the drain passage but not the supply passage.

19 Claims, 6 Drawing Sheets

DISHWASHER

CROSS-REFERENCE TO RELATED APPLICATIONS

This application claims the benefit of the Korean Patent Application No. 10-2008-0081801, filed on Aug. 21, 2008, which is hereby incorporated by reference as if fully set forth herein.

BACKGROUND

1. Field of the Invention

One or more embodiments disclosed herein relate to dishwashers or other washing appliances.

2. Background

Most dishwashers include a nozzle, a driving unit, and a rack for holding dishes. The driving unit may be formed from a sump for collecting water and a wash pump for pumping the water from the sump through the nozzle and onto the dishes. The dishwasher may also include a supply passage for supplying water to a washtub, a drain passage for draining contaminated water from the dishwasher, and a drain pump for discharging water stored in the sump through the passage.

Dishwashers of the aforementioned type have several disadvantages. For example, the supply passage is coupled to a disposer. As a result, garbage from the disposer is supplied to the washtub with water during a washing cycle. To compensate, an increased quantity of water is flushed through the supply passage so that the garbage will not enter or be retained within the washtub of the dishwasher to contaminate the clean dishes. This wastes resources and increases costs.

DETAILED DESCRIPTION

Figure 1:
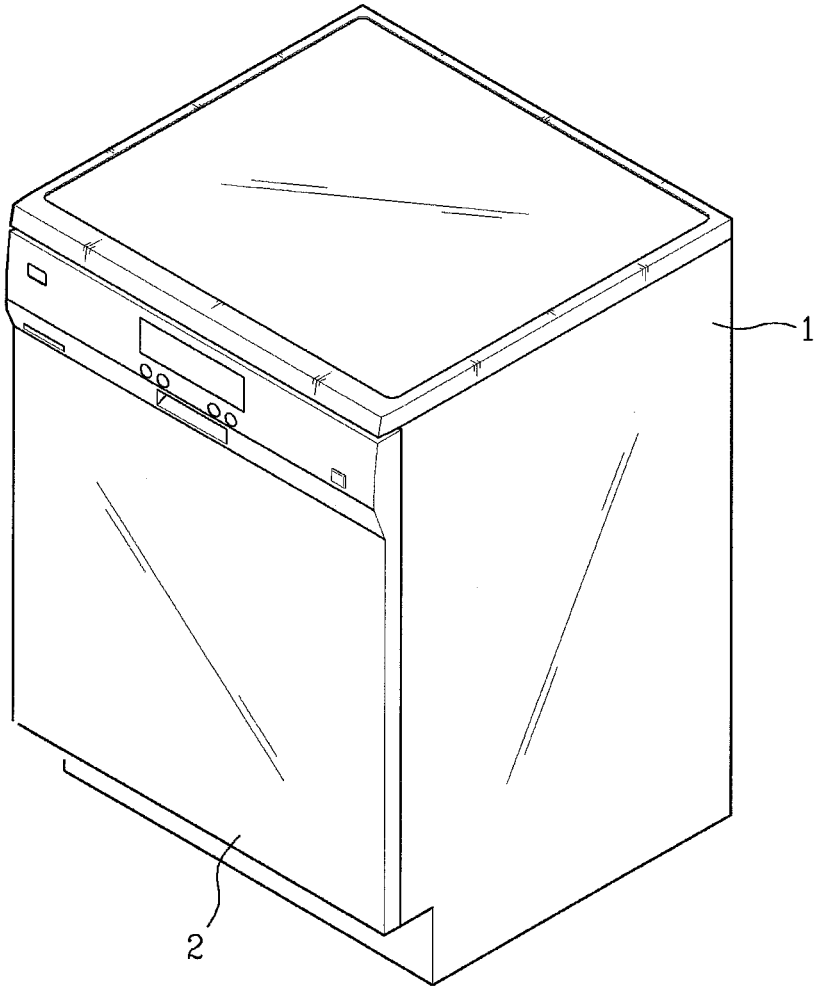
FIG. 1 is a diagram showing one embodiment of a dishwasher.
Figure 2:
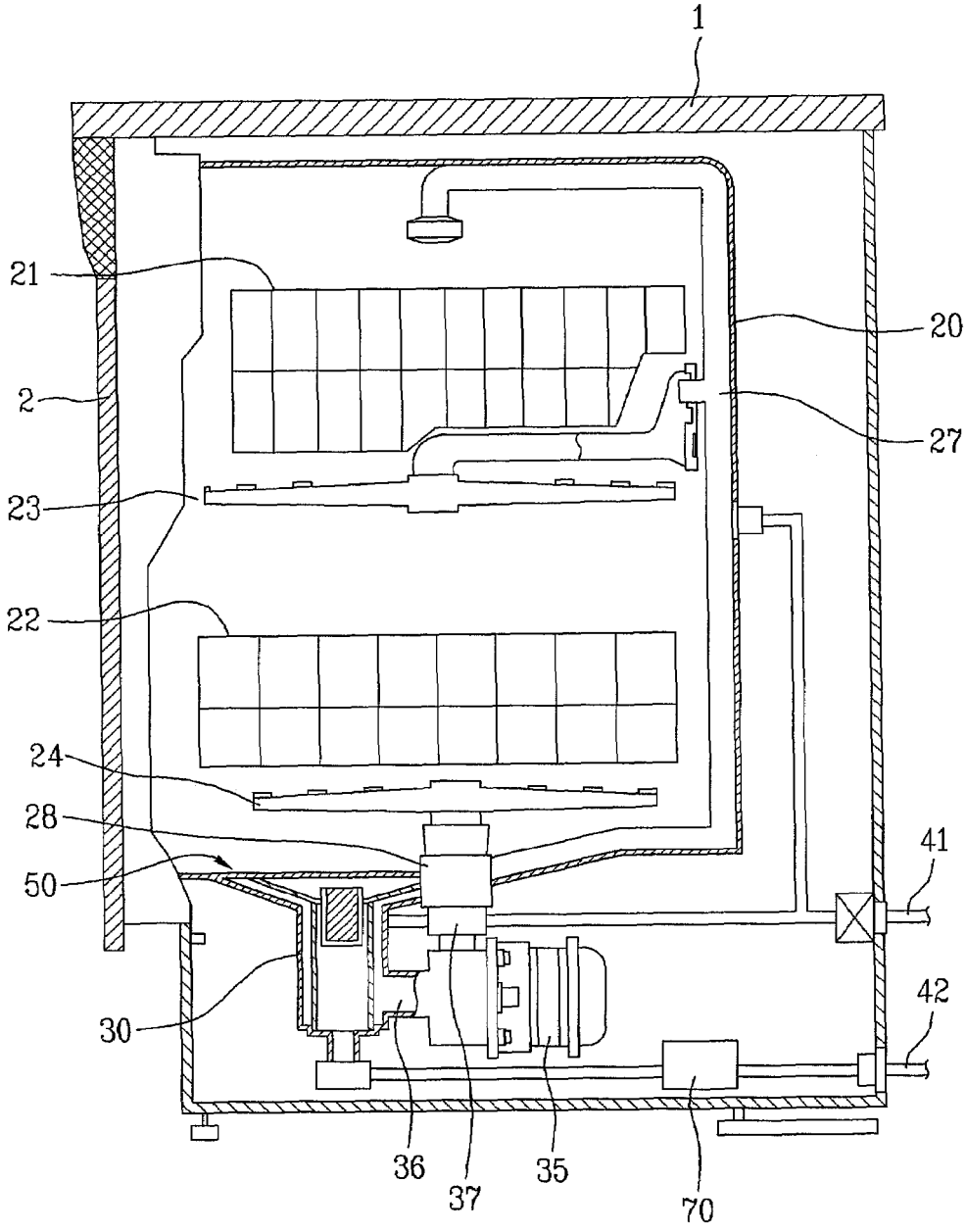
FIG. 2 is a cross-sectional diagram of the dishwasher shown in FIG. 1.

FIGS. 1 and 2 show one embodiment of dishwasher that includes a case 1 having an open front side and a door 2 which opens and closes relative to the front side. The case also includes a washtub 20 for accommodating water therein, and a sump 30 is also provided at a bottom of the washtub. The sump collects water sprayed into the washtub, and a filter assembly 50 is provided in advance of a water flow path relative to the sump to filter particles from the water introduced into the sump.

The interior of the washtub includes upper and lower racks 21 and 22 that are vertically separated to accommodate dishes and other tableware, and upper and lower nozzles 23 and 24 are provided to spray water toward the upper and lower racks. Upper and lower passages 27 and 28 are provided to supply the water collected in sump 30 to upper and lower nozzles 23 and 24 respectively.

In addition to the foregoing features, a water supply passage 41 is provided to enable water to be supplied into the washtub. The supply of water is provided from a water supply source located outside the case. A drain passage 42 drains contaminated water for discharge outside the dishwasher. A drain pump 70 is provided to the drain passage to drain the water collected in sump 30 from the dishwasher. The drain passage 42 may include a damping member such as a rubber pipe and/or a flexible pipe to absorb vibration.

Figure 3:
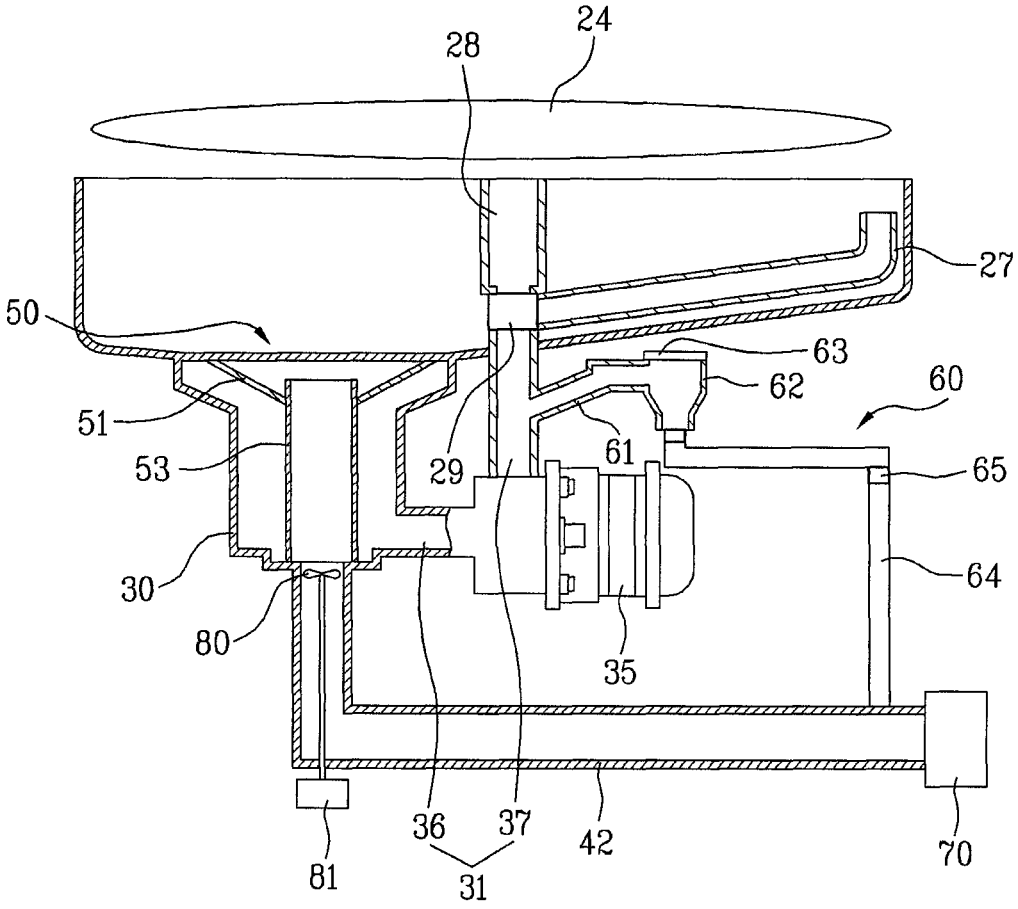
FIG. 3 is a cross-sectional diagram of a sump of the dishwasher of FIG. 2.

FIG. 3 shows a supply passage 31 provided to supply water collected in the sump 30 to the washtub 20 from a location under the washtub 20. A wash pump 35 is provided to the supply passage 31 for supplying water to upper and lower nozzles 23 and 24. The supply passage 31 includes an inlet pipe 36 that connects the sump 30 and wash pump 35 together and an outlet pipe 37 that connects the wash pump 35 and the upper and lower passages 27 and 28. The supply passage 31 may include a damping member such as a rubber pipe and/or a flexible pipe to absorb vibration.

As also shown in FIG. 3, water pumped by wash pump 35 is selectively sprayed via the upper and lower passages 27 and 28. A diverging portion between the upper and lower passages includes a passage switching valve 29 for enabling water supplied by the wash pump to be selectively supplied to the upper and lower passages 27 and 28.

The sump also includes a filter assembly 50 for filtering particles from the water introduced into the sump. The filter assembly may include a middle filter 51 provided over sump 30. The middle filter may have a hollow dish shape, and a coarse filter 53 may be provided under the middle filter to have a cylindrical shape. The sizes of perforated holes in the middle filter may be smaller than that the perforated holes in coarse filter 53, and a bottom of the coarse filter may have an open configuration.

Using this filter assembly, particles that are relatively large in size among particles in the water introduced into sump 30 will not be sucked into wash pump 35, but rather will be collected in the drain passage 42 which is coupled to the bottom of the coarse filter 53.

In addition to filter assembly 50, a filtering arrangement 60 may be included for removing particles from the water. This filtering arrangement may include a pipe 61 that diverges from one side of outlet pipe 37, a garbage chamber 62 for collecting particles in the water introduced from the diverging pipe, and a filter 63 adjusted to (e.g., over or on top of) the garbage chamber to filter particles from water introduced into the garbage chamber.

A discharge passage 64 is coupled to a bottom of the garbage chamber to drain the particles collected in the garbage chamber. The discharge passage may be coupled to drain passage 42. A valve 65 may be included in or in advance of the flow of the discharge passage, so that the particles collected in the garbage chamber can be discharged into the drain passage via the discharge passage 64 only if the valve 65 is turned on. Drain pump 70 is coupled to drain passage 42 for draining water collected in the sump 30.

While the dishwasher is operating, drain pump 70 is not working. As a result, relatively large particles gather within drain passage 42. Thus, a disposer 80 is provided to discharge the large particles that gathered within drain passage 42 from the dishwasher. The disposer performs this function by grinding or pulverizing the particles into smaller particles, as the disposer is driven by a motor 81.

According to one embodiment, the disposer 80 is installed at a location lower than that of supply passage 31. This location is preferable in some instances because if the disposer is located higher than the supply passage, the particles ground by the disposer may be introduced into the supply passage.

Figure 4:
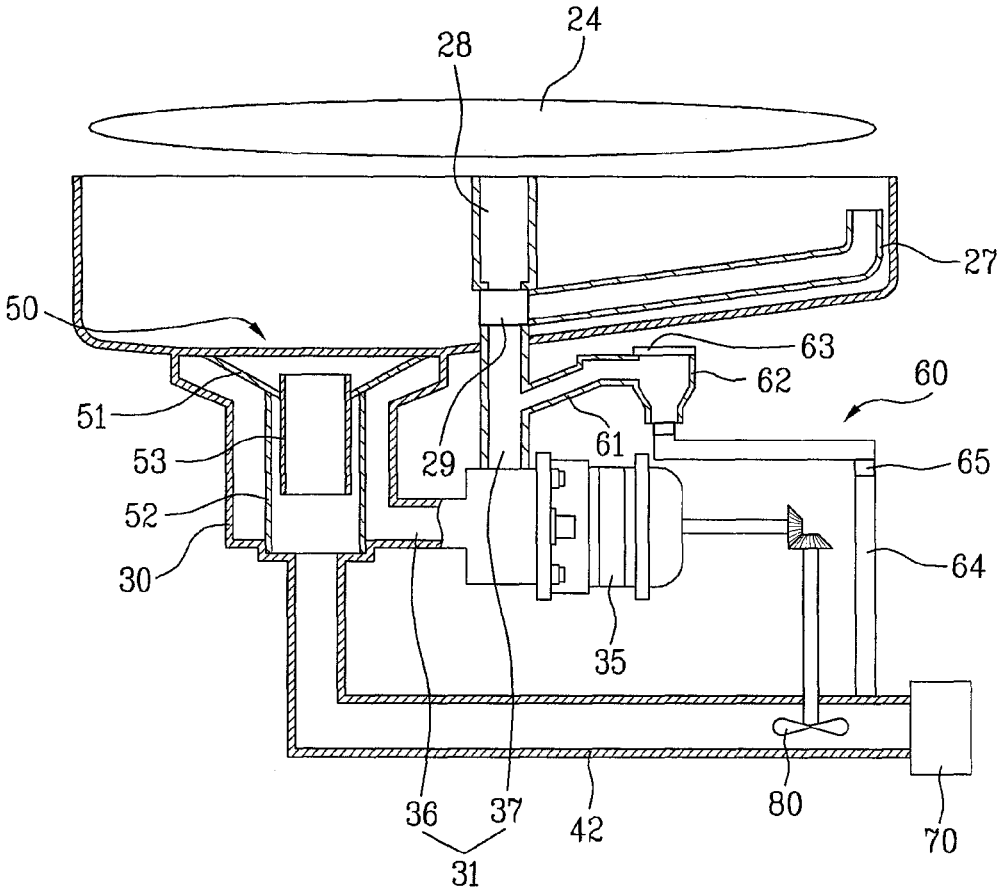
FIG. 4 is a diagram showing an embodiment having a disposer driven by a motor for driving a wash pump.

FIG. 4 shows another embodiment of a dishwasher, where the disposer is in a location different from the disposer in FIG. 3. In this second embodiment, the disposer is driven by the same motor used to drive the wash pump 35. No separate motor is therefore required to drive the disposer. In order to enable the disposer to be driven by the wash pump motor, a rotational shaft of the motor is configured to be coupled with a rotational shaft rotated by the disposer, via, for example, a bevel gear.

As a result of this arrangement, if the wash pump is driven to supply the water collected in sump 30 to the washtub, the disposer is rotated to grind particles that have gathered in the drain passage 42.

The filter assembly in FIG. 4 may also be different from the filter assembly in FIG. 3. For example, filter assembly 50 may further include a fine filter 52 provided outside coarse filter 53 in order to filter fine particles. Therefore, it is able to filter fine particles introduced toward supply passage 31 in part as well.

Operation of the dishwasher will now be provided. In an initial step, a user puts tableware on upper and/or lower racks 21 and 22 and then activates the dishwasher. Once activated, water and detergent are supplied into washtub 20. As wash pump 35 is driven, upper and lower nozzles 23 and 24 spray the water on the tableware. The water is sprayed as it passes through upper and lower passages 27 and 28 by the centrifugal force of the wash pump 35.

The water used in washing the tableware flows down to the bottom of the washtub and introduced into the sump 30. Some of the particles contained in the water introduced into the sump are filtered by filter assembly 50 and the rest of the particles gather in the drain passage 42. The water filtered by the filter assembly is re-sprayed by wash pump 35. And, the water sprayed by the wash pump is introduced into garbage chamber 62 via diverging pipe 61 in part and then is filtered by the filter 63.

Meanwhile, while the wash pump is operating, relatively large particles gathered in the drain passage 42 are grinded by the disposer 80.

After completion of the washing cycle of the dishwasher, valve 65 is opened to allow particles gathered in garbage chamber 62 to pass into discharge passage 64 and then into drain passage 42. At the same time, drain pump 70 is activated to discharge both the water and garbage from the dishwasher.

Figure 5:
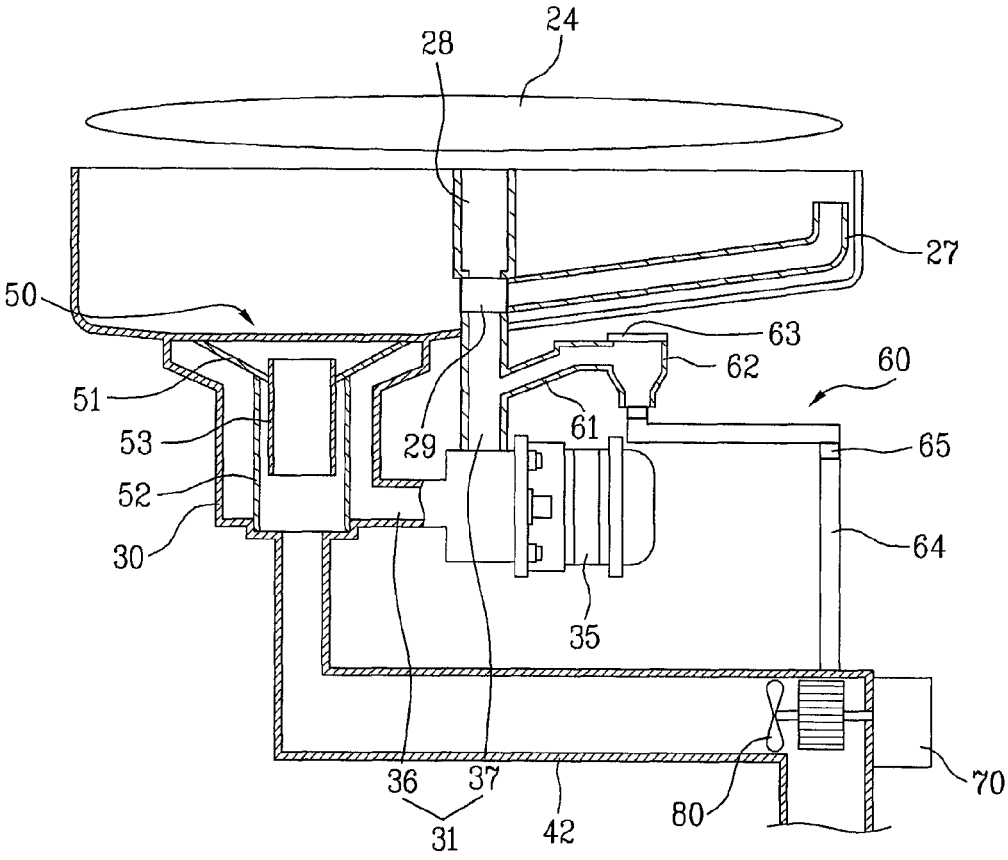
FIG. 5 is a diagram showing an embodiment having a disposer driven by a motor for driving a drain pump.

FIG. 5 is a diagram for depicting an embodiment of the dishwasher where the disposer 80 is driven by the motor for driving the drain pump 70. When the disposer is driven by the drain pump motor, particles gathered in drain passage 42 are ground while the drain pump is operating. As a result, when water is discharged from the dishwasher, particles in the water are grinded.

Figure 6:
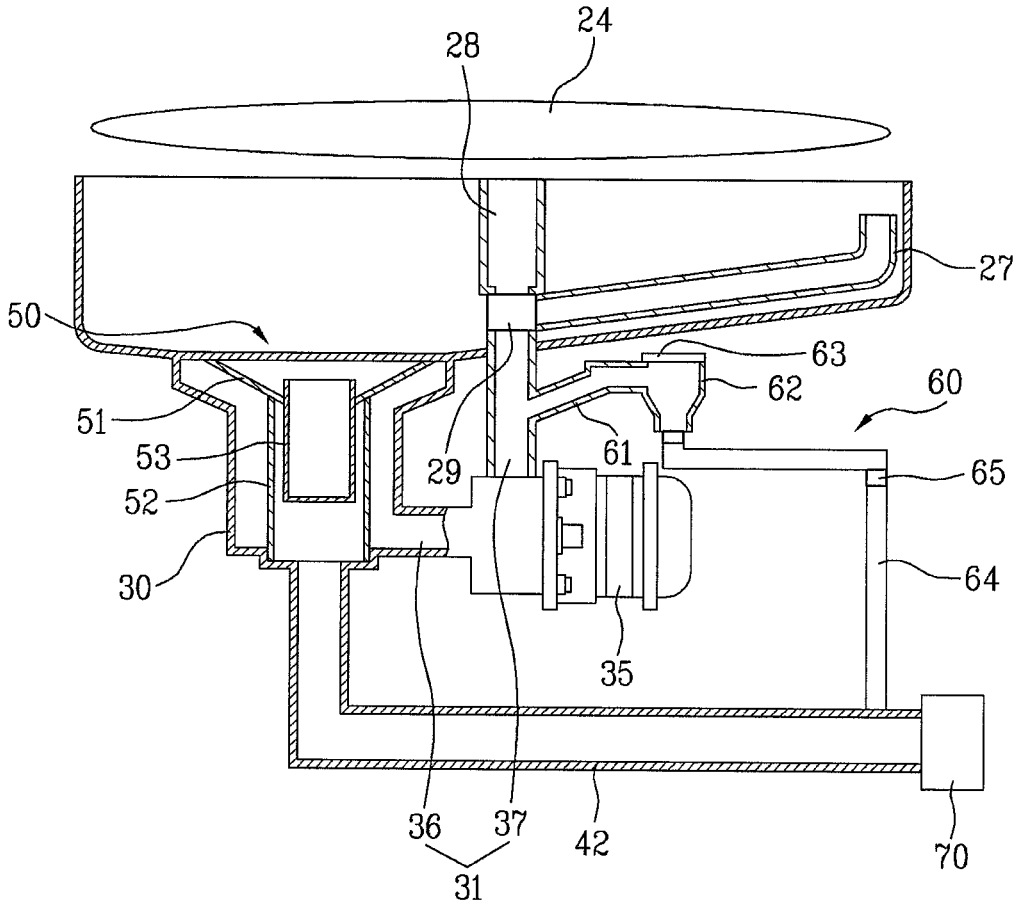
FIG. 6 is a diagram showing an embodiment where a bottom of a coarse filter in a sump is blocked and no disposer is included.

FIG. 6 shows a dishwasher according to another embodiment. This embodiment is different in that a bottom of coarse filter 53 in filter assembly 50 is not open. This embodiment is also different in that it does not include a disposer in drain passage 42.

In operation, large particles among the particles in the water introduced into sump 30 from washtub 20 are filtered by coarse filter 53 of the filter assembly. As a result, it is unnecessary to provide a disposer in drain passage 42. In this case, a user dissembles the coarse filter from the filter assembly and then manually disposes of the particles filtered by the coarse filter.

Accordingly, one or more of the embodiments disclosed herein do not provide a disposer that grinds or pulverizes particles to a supply passage for supplying water, thereby reducing a quantity of water supplied to a washtub.

In accordance with one embodiment, a dishwasher is provided that washes tableware using a small quantity of water. This is accomplished by separating a passage for supplying water from a passage that is used to accumulate and/or discharge contaminants and garbage derived from washing the tableware during a washing cycle.

In accordance with another embodiment, a dishwasher includes a washtub, a sump collecting water sprayed into the washtub, a supply passage for supplying the water collected in the sump to the washtub, a wash pump provided to the supply passage to pumping the water to the washtub, a drain passage for guiding the water collected in the sump to be discharged from the dishwasher, and a disposer provided to the drain passage to grind garbage. Preferably, the disposer is located lower than the supply passage.

The dishwasher may further include a garbage chamber for collecting the garbage contained in the introduced water pumped by the wash pump in part. In addition, an exit of the garbage chamber may be configured to communicate with the drain passage.

The dishwasher may further include a coarse filter for filtering off the garbage introduced into the supply passage. In this case, the coarse filter is configured to have an open bottom. And, a fine filter for filtering off fine garbage is provided to an outside of the coarse filter.

According to one embodiment, the disposer is driven by a motor for driving the wash pump. According to another embodiment, the dishwasher includes a drain pump provided to the drain passage to drain the water collected in the sump from the washtub. In this embodiment, the disposer may be driven by a motor for driving the drain pump. The motor may include a dual-shaft motor. Also, the supply passage may include a damping member or the drain passage may include a damping member.

According to one or more of the aforementioned embodiments, water containing contaminates and garbage is prevented from being supplied into a washtub, by separating a passage for supplying water and a passage for accumulating the garbage and contaminates from each other. As a result, washing tableware is performed using less water than other types of dishwashers.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A dishwasher, comprising:

a washtub;

a sump that collects water sprayed into the washtub;

a supply passage that supplies the water in the sump to the washtub;

a wash pump that pumps the water in the sump to the washtub through the supply passage;

a drain pump that pumps the water in the sump out of the dishwasher;

a drain passage that guides the water in the sump for discharge from the dishwasher, the drain passage having one end connected to the sump and the other end connected to the drain pump; and a disposer that grinds garbage, wherein the disposer is provided in the drain passage between the one end of the drain passage connected to the sump and the other end of the drain passage connected to the drain pump, wherein one end of the supply passage is connected to a lower part of the sump, and wherein the disposer and the supply passage are disposed out of the sump.

2. The dishwasher of claim 1, wherein the disposer is provided at a location lower than the supply passage.

3. The dishwasher of claim 1, further comprising:

a garbage chamber that collects the garbage in the water pumped by the wash pump.

4. The dishwasher of claim 3, wherein an exit of the garbage chamber is configured to communicate with the drain passage.

5. The dishwasher of claim 3, further comprising:

a coarse filter that prevents large particles of the garbage from being introduced into the supply passage.

6. The dishwasher of claim 5, wherein the coarse filter is configured to have an open bottom.

7. The dishwasher of claim 6, further comprising:

a fine filter, adjacent the coarse filter, that filters fine particles of the garbage.

8. The dishwasher of claim 1, wherein the disposer is driven by a motor that drives the wash pump.

9. The dishwasher of claim 1, wherein the disposer is driven by a motor that drives the drain pump.

10. The dishwasher of one of claim 9, wherein the motor comprises a dual-shaft motor.

11. The dishwasher of claim 1, wherein the supply passage comprises a damping member.

12. The dishwasher of claim 1, wherein the drain passage comprises a damping member.

13. A dishwasher, comprising:

a sump that collects water from a washtub;

a filter assembly coupled to the sump; and a drain passage that receives water from the filter assembly, wherein the filter assembly includes a middle filter that filters particles of a first size and a coarse filter that filters particles of a second size larger than the first size, wherein the coarse filter is provided under the middle filter and is detachably assembled to the middle filter, wherein the filter assembly is provided between an inlet of the sump and a supply passage that carries the water collected in the sump to the washtub, and wherein the middle filter has a hollow dish shape and the coarse filter has a cylindrical shape.

14. The dishwasher of claim 1, wherein the supply passage is disposed out of the sump.

15. The dishwasher of claim 14, wherein the wash pump is provided at the supply passage, and wherein the wash pump is disposed out of the sump.

16. The dishwasher of claim 13, further comprising a fine filter provided outside the coarse filter that filters fine particles smaller than the first size.

17. The dishwasher of claim 13, wherein the coarse filter is configured to have an open bottom.

18. The dishwasher of claim 17, wherein the drain passage is coupled to the bottom of the coarse filter.

19. The dishwasher of claim 13, wherein the middle filter and the coarse filter each includes a plurality of perforated holes, and wherein a size of the plurality of perforated holes of the middle filter is smaller than a size of the plurality of holes of the coarse filter.

* * * * *